US009774126B2

(12) United States Patent
Tateishi et al.

(10) Patent No.: US 9,774,126 B2
(45) Date of Patent: Sep. 26, 2017

(54) ELECTRICAL CONNECTOR WHICH THROUGH-HOLES ARE PARTITIONED FROM THE ADJOINING THROUGH-HOLE BY A TABULAR PARTITION THAT COUPLED WITH THE OPERATION LEVER

(71) Applicant: Dai-ichi Seiko Co, Ltd., Kyoto-shi, Kyoto (JP)

(72) Inventors: Jin Tateishi, Ogori (JP); Yuki Nakamura, Ogori (JP)

(73) Assignee: DAI-ICHI SEIKO CO., LTD., Fushimi-Ku, Kyoto-Shi, Kyoto (JP)

( * ) Notice: Subject to any disclaimer, the term of this patent is extended or adjusted under 35 U.S.C. 154(b) by 0 days.

(21) Appl. No.: 14/684,849

(22) Filed: Apr. 13, 2015

(65) Prior Publication Data

US 2015/0311620 A1 Oct. 29, 2015

(30) Foreign Application Priority Data

Apr. 23, 2014 (JP) ..... 2014-089092

(51) Int. Cl.
*H01R 13/15* (2006.01)
*H01R 13/46* (2006.01)
*H01R 12/88* (2011.01)

(52) U.S. Cl.
CPC ..... *H01R 13/46* (2013.01); *H01R 12/88* (2013.01)

(58) Field of Classification Search
CPC ..... H01R 23/684; H01R 13/193
USPC ..... 439/260, 261, 495
See application file for complete search history.

(56) References Cited

U.S. PATENT DOCUMENTS 6,478,474 B1 * 11/2002 Sander ..... G02B 6/3839 385/136
7,094,093 B2 * 8/2006 Nakano ..... H01R 12/88 439/495
8,382,504 B2 * 2/2013 Matoba ..... H01R 12/88 439/350
2005/0136732 A1 6/2005 Suzuki
(Continued)

FOREIGN PATENT DOCUMENTS

JP 2008-108458 A 5/2008
JP 2009181847 A 8/2009
(Continued)

OTHER PUBLICATIONS

European Search Report (EP 15 16 4266); dated Jun. 6, 2015.
(Continued)

*Primary Examiner* — Abdullah Riyami
*Assistant Examiner* — Thang Nguyen
(74) *Attorney, Agent, or Firm* — Howard & Howard Attorneys PLLC

(57) ABSTRACT

An actuator includes a tabular partition that partitions, for each beam located at a position that allows the beam to abut the actuator, a through-hole into which one of a pair of beams located at the other-end side and at the position that allows the beam to abut the actuator is inserted to prevent the beam from abutting the actuator, and a wider-width part including a wider-width surface which is disposed at one end of the partition corresponding to an upstream side of a flow of resin flowed to mold the partition when the actuator is molded by the resin containing a filler, and which has a wider width than a width of the one end of the partition.

5 Claims, 11 Drawing Sheets

(56) References Cited

U.S. PATENT DOCUMENTS

| | | | | |
|---|---|---|---|---|
| 2006/0105622 | A1* | 5/2006 | Nakano | H01R 12/771 439/495 |
| 2008/0233781 | A1* | 9/2008 | Matoba | H01R 12/778 439/258 |
| 2009/0298315 | A1* | 12/2009 | Iida | H01R 12/79 439/259 |
| 2010/0087078 | A1 | 4/2010 | Hemmi et al. | |
| 2013/0023138 | A1* | 1/2013 | Sasaki | H01R 12/88 439/260 |

FOREIGN PATENT DOCUMENTS

| | | | |
|---|---|---|---|
| JP | 2011090799 | A | 5/2011 |
| JP | 2012113948 | A | 6/2012 |
| JP | 2013166282 | A | 8/2013 |
| TW | I399892 | B | 6/2013 |

OTHER PUBLICATIONS

Japanese Office Action (with English translation) dated Dec. 22, 2015 for Japanese Patent Application No. 2014-089092.
Taiwan Office Action (English Translation and then Taiwan Office Action); dated Aug. 8, 2016.

* cited by examiner

ELECTRICAL CONNECTOR WHICH THROUGH-HOLES ARE PARTITIONED FROM THE ADJOINING THROUGH-HOLE BY A TABULAR PARTITION THAT COUPLED WITH THE OPERATION LEVER

CROSS-REFERENCE TO RELATED APPLICATION

This application claims the benefit of Japanese Patent Application No. 2014-089092, filed Apr. 23, 2014, the entire disclosure of which is incorporated by reference herein.

FIELD

This application relates generally to an electrical connector.

BACKGROUND

Electrical connectors are known which have signal transmission members typified by FPCs (Flexible Printed Circuits) and fitted in a slot of an insulative housing that constructs the connector to electrically connect a substrate on which the connector is mounted with the electrodes of the signal transmission member.

According to this type of electrical connectors, in general, an actuator provided with an operation lever to be operated by a user is attached to the housing in a freely rotatable manner. When the actuator is rotated so as to be substantially parallel to the fitting direction of the signal transmission member by the user operation given to the operation lever, the end portions of contacts located in the slot of the housing come close to the electrodes of the signal transmission member, and thus each contact and each electrode contact with each other.

This type of actuator is formed with through-holes through which the respective contacts located at a position that allows the contact to abut the actuator are inserted to prevent that contact from abutting the actuator.

Those through-holes are partitioned from the adjoining through-hole by a tabular partition that has one end coupled with the operation lever.

CITATION LIST

Patent Literature

[Patent Literature 1] Unexamined Japanese Patent Application Kokai Publication No. 2008-108458.

SUMMARY

The Patent Literature 1 discloses electrical connectors and the like which have the advancement in reduction of the disposing pitch of the contacts (narrow pitching) in accordance with a request for downsizing. According to this reduction, the width of the partition in the direction in which the contacts are disposed side by side is also reduced.

In this case, when the width of the partition decreases, the rigidity of the partition decreases. Hence, due to shock by, for example, falling of the electrical connector, the partition is likely to be chipped or bent.

In view of such a circumstance, when a resin is filled in a die to integrally mold the actuator, it is necessary to apply a resin that has high rigidity. Hence, the filler contained in the resin tends to be long.

When, however, the width of the partition decreases, the area of the coupling part between the partition and the major body of the operation lever becomes small. Hence, when the filler to be contained in the resin is long, the filler is likely to remain at a coupling portion in the die between a portion where the partition is to be molded and a portion where the operation lever is to be molded. Consequently, the filler is not likely to flow in the portion where the partition is to be molded.

Accordingly, when the filler contained in the resin is long, according to the shape of the actuator disclosed in the Patent Literature 1, the partition that has insufficient rigidity is to be formed.

The present disclosure has been made in view of the aforementioned circumstances, and it is an objective of the present disclosure to provide an electrical connector that includes a partition with sufficient rigidity.

Solution to Problem

To accomplish the above objective, an electrical connector according to an aspect of the present disclosure includes:

an insulative housing that is formed with a slot in which a tabular signal transmission member is fittable;

a plurality of contacts each including an elastic conductor in a substantially H shape including a pair of beams and a pillar that connects the pair of beams with each other, the pair of beams located at one-end side with reference to the pillar being disposed in the slot of the housing so as to correspond to respective electrodes of the signal transmission member fitted in the housing through the slot; and an actuator attached to the housing in a freely rotatable manner, including a shaft which is held between the pair of beams at an other-end side with reference to the pillar, and which is rotatable around an axial center along with the rotation of the actuator, and enabling the plurality of contacts to contact the electrodes upon rotation of the shaft, in which the actuator comprises:

a tabular partition that partitions, for each beam located at a position that allows the beam to abut the actuator, a through-hole into which one of the pair of beams located at the other-end side and at the position that allows the beam to abut the actuator is inserted to prevent the beam from abutting the actuator; and a wider-width part including a wider-width surface which is disposed at one end of the partition corresponding to an upstream side of a flow of resin flowed to mold the partition when the actuator is molded by the resin containing a filler, and which has a wider width than a width of the one end of the partition.

The actuator may further include an operation part to be rotated;

the one end of the partition may be connected with the operation part; and the wider-width part may be disposed between the operation part corresponding to the upstream side of the resin flow and the one end of the partition.

The one end of the partition may be connected with the shaft; and the wider-width part may be disposed between the shaft corresponding to the upstream side of the resin flow and the one end of the partition.

Among contour lines of the wider-width surface, two lines that couple the upstream side of the resin flow with the downstream side thereof may be straight lines that increase the width of the wider-width surface toward the upstream side from the downstream side.

Among contour lines of the wider-width surface, two lines that couple the upstream side of the resin flow with the downstream side thereof may be curved lines that increase the width of the wider-width surface toward the upstream side from the downstream side.

A maximum width of the wider-width surface may be greater than a length of the filler contained in the resin that molds the actuator.

According to the present disclosure, the wider-width part including a wider-width surface with a larger width than the width of one of the partition is disposed at the one end of the partition corresponding to the upstream side of the resin flow that is flowed to mold the partition. The wider-width part has a function of, when the actuator is molded by the resin containing a filler, guiding the filler contained in the resin to the one end of the partition, and of facilitating the filler to flow in the partition. Hence, according to the present disclosure, the partition can have sufficient rigidity.

BRIEF DESCRIPTION OF THE DRAWINGS

A more complete understanding of this application can be obtained when the following detailed description is considered in conjunction with the following drawings, in which.

DETAILED DESCRIPTION

First Embodiment

An explanation will be given of an electrical connector 10 according to a first embodiment of the present disclosure. In respective accompanying figures, the shorter-side direction of the electrical connector 10 is defined as an x-axis direction, the longer-side direction is defined as a y-axis direction, and the thickness direction is defined as a z-axis direction to set an orthogonal coordinate system, and this coordinate system will be referred as needed. In addition, the direction of an arrow in each axis is expressed by a symbol + (plus), while the opposite direction is expressed by a symbol – (minus).

Figure 1:
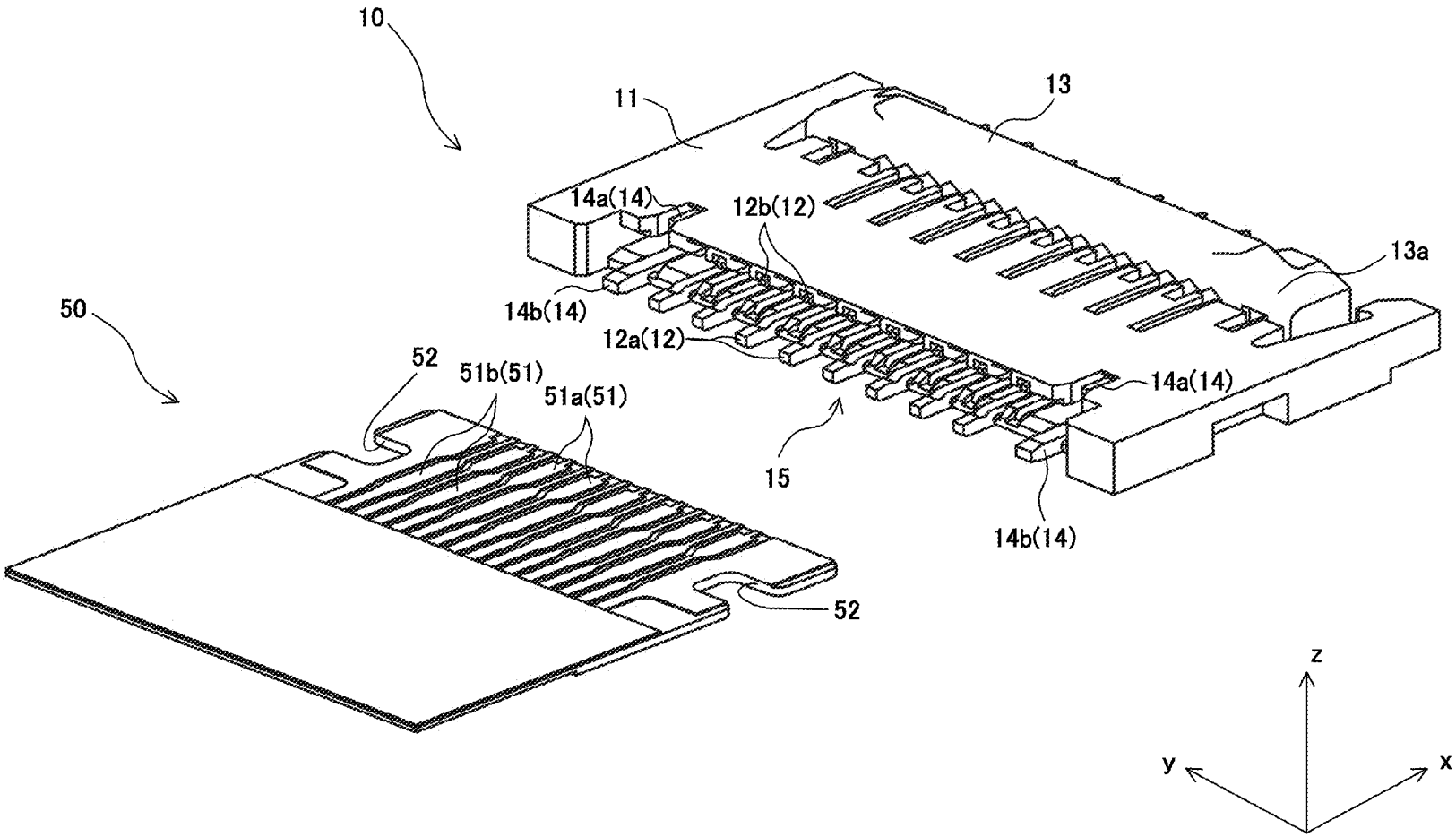
FIG. 1 is a perspective view when an actuator of an electrical connector according to a first embodiment of the present disclosure is in a free condition.
Figure 2:
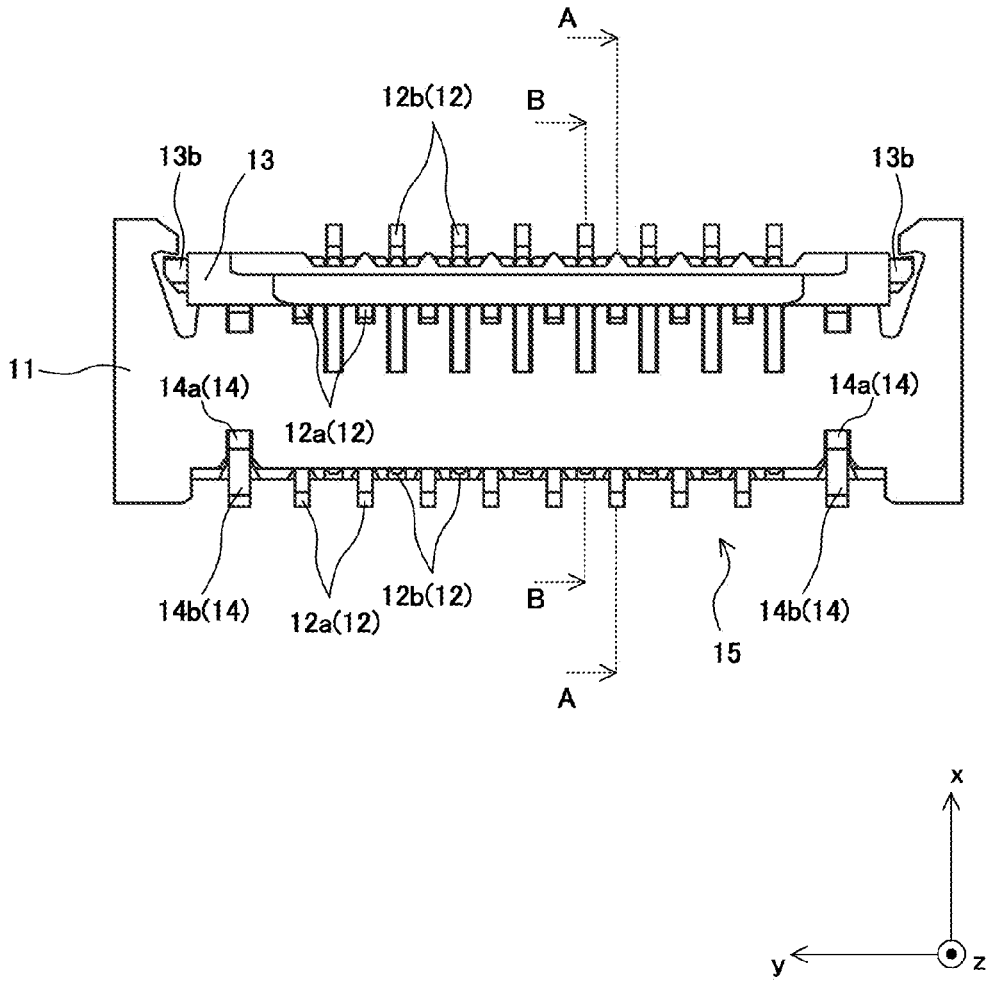
FIG. 2 is a top view when the actuator of the electrical connector of the present disclosure is in a free condition.

As illustrated in FIGS. 1 and 2, the electrical connector 10 includes a rectangular housing 11, contacts 12 disposed in the housing 11, an actuator 13 attached to the housing 11 in a freely rotatable manner, and lockings 14 disposed in the housing 11.

The housing 11 is formed of an insulative material like a resin, and is disposed on, for example, a wiring board of an electronic device. The housing 11 is formed with a slot 15 in which an FPC 50 that is an example tabular signal transmission member is fittable. The opening of the slot 15 is wide at the front side, and is narrow at the back side.

Figure 10A:
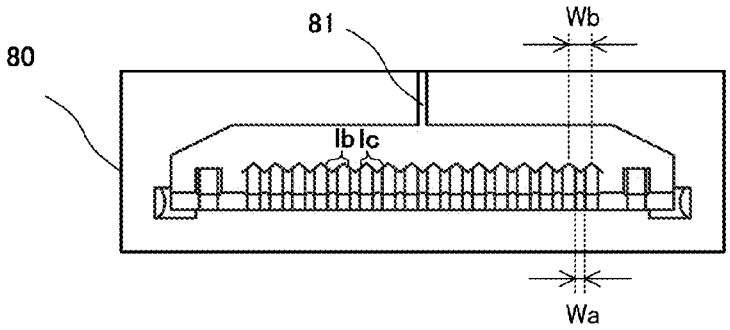
FIG. 10A is a schematic diagram of a die that integrally molds the actuator according to the first embodiment of the present disclosure.
Figure 10B:
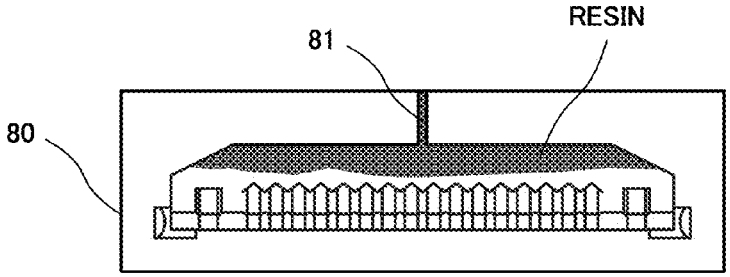
FIG. 10B is a (first) diagram illustrating how a resin flows in the die illustrated in the schematic diagram of FIG. 10A step by step.
Figure 10C:
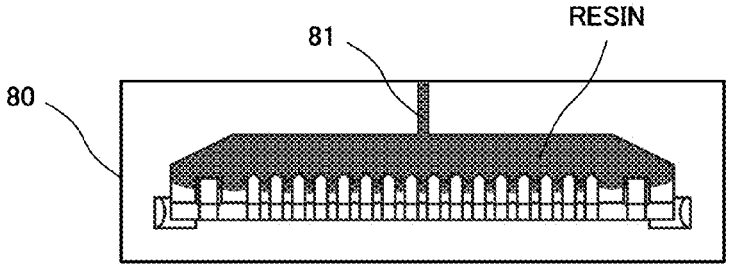
FIG. 10C is a (second) diagram illustrating how the resin flows in the die illustrated in the schematic diagram of FIG. 10A step by step.
Figure 10D:
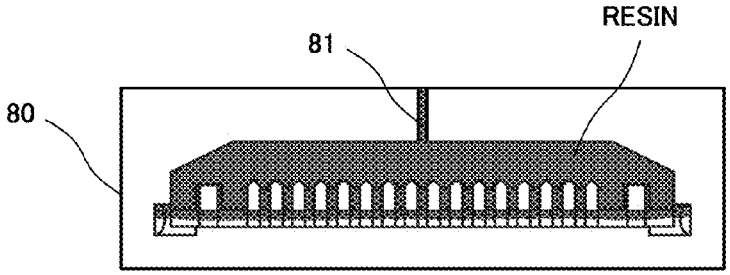
FIG. 10D is a (third) diagram illustrating how the resin flows in the die illustrated in the schematic diagram of FIG. 10A step by step.

FIG. 10B is a (first) diagram illustrating how a filler contained resin flows in the die illustrated in the schematic diagram of FIG. 10A step by step;

FIG. 10C is a (second) diagram illustrating how the filler contained resin flows in the die illustrated in the schematic diagram of FIG. 10A step by step;

FIG. 10D is a (third) diagram illustrating how the filler contained resin flows in the die illustrated in the schematic diagram of FIG. 10A step by step;

The contacts 12 are each an elastic conductor like a metal. The contacts 12 include two kinds of contacts that are first contacts 12*a* and second contacts 12*b*. The first contacts 12*a* are disposed at locations corresponding to the first electrodes 51*a* of the FPC 50 fitted in the housing 11. The second contacts 12*b* are disposed at locations correspond to the second electrodes 51*b* of the FPC 50 fitted in the housing 11. Those contacts 12*a*, 12*b* are fastened to the housing 11.

The first contacts 12*a* and the second contacts 12*b* are alternately disposed in the longer-side direction (y-axis direction) of the housing 11.

The actuator 13 is disposed at the back side (opposite side to the slot 15) of the housing 11. The actuator 13 includes an operation part 13*a* that extends along the longer-side direction (y-axis direction) of the housing 11, and, as illustrated in FIG. 2, abutting parts 13*b* disposed at both ends of the operation part 13*a* in the longer-side direction. The longer-side direction of the operation part 13*a* is substantially parallel to the longer-side direction of the housing 11.

The abutting parts 13*b* are retained in respective recesses provided in the housing 11, and are attached in a freely rotatable manner relative to the housing 11. Hence, the user (operator) can rotate the actuator 13 by rotating the operation part 13*a*.

Next, a detailed explanation will be given of the above-explained first contacts 12*a*, second contacts 12*b*, and actuator 13.

Figure 3:
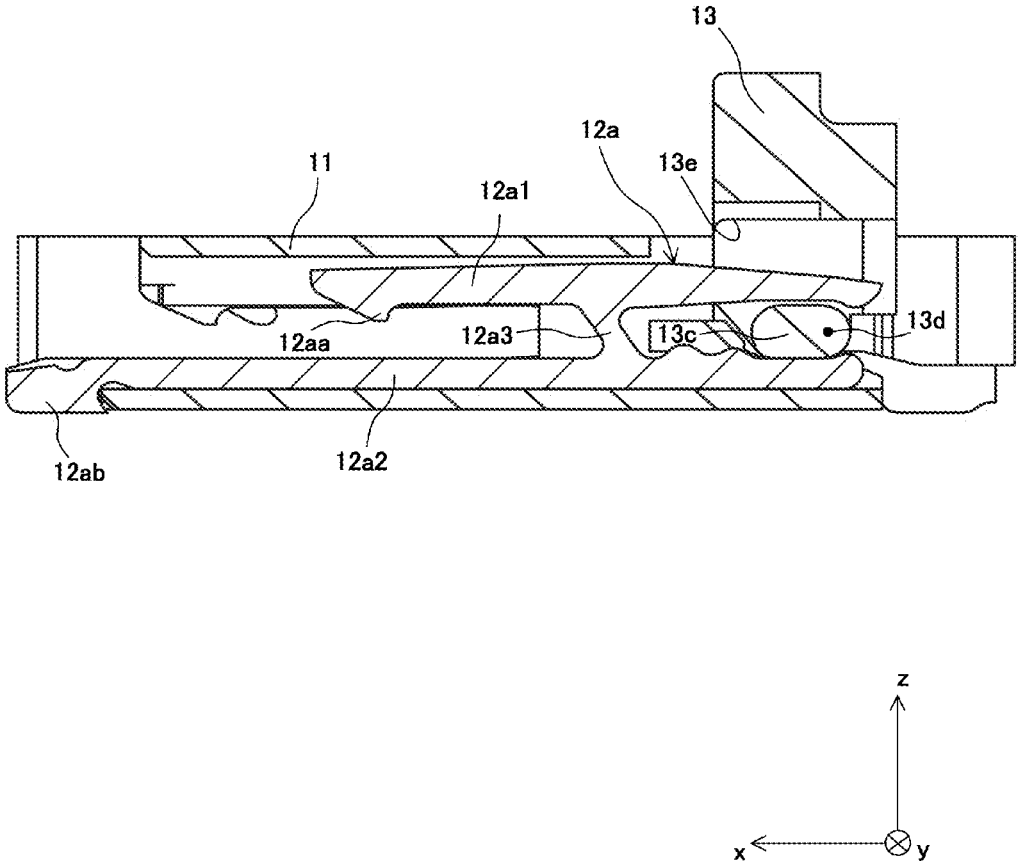
FIG. 3 is a cross-sectional view of the electrical connector along a line A-A in FIG. 2.

As illustrated in FIG. 3 (a cross-sectional view along a line A-A in FIG. 2), the first contacts 12*a* each include a pair of beams 12*a*1, 12*a*2 (an upper beam 12*a*1, and a lower beam 12*a*2 that is longer than the upper beam 12*a*1). In addition, the first contacts 12*a* each include a pillar 12*a*3 that connects the upper beam 12*a*1 with the lower beam 12*a*2. The first contacts 12*a* are each in a substantially H shape.

The pair of beams (upper beam 12*a*1 and lower beam 12*a*2) located at the one-end side of the first contact 12*a* with reference to the pillar 12*a*3 is disposed and exposed in the slot 15 of the housing 11. Between the pair of beams located at the one-end side of the first contact 12*a* (slot-15 side with reference to the pillar 12*a*3), the upper beam 12*a*1 has an end portion provided with a first contact part 12*aa* that can abut the first electrode 51*a*. In addition, between the pair of beams located at the one-end side of the first contact 12*a*, the lower beam 12*a*2 has an end portion provided with a first connection part 12*ab* to be soldered to, for example, the electrode of the wiring board of an electronic device.

Still further, the pair of beams (upper beam 12*a*1 and lower beam 12*a*2) located at the other-end side of the first contact 12*a* with reference to the pillar 12*a*3 (back side of the housing 11 with reference to the pillar 12*a*3) are exposed at the back side of the housing 11.

Held between the pair of beams (upper beam 12*a*1 and lower beam 12*a*2) at the other-end side of the first contact 12*a* is a shaft 13*c* of the actuator 13. The shaft 13*c* is rotatable around an axial center 13*d* along with the rotation of the actuator 13. The shaft 13*c* has an elliptical cross-section.

Figure 4:
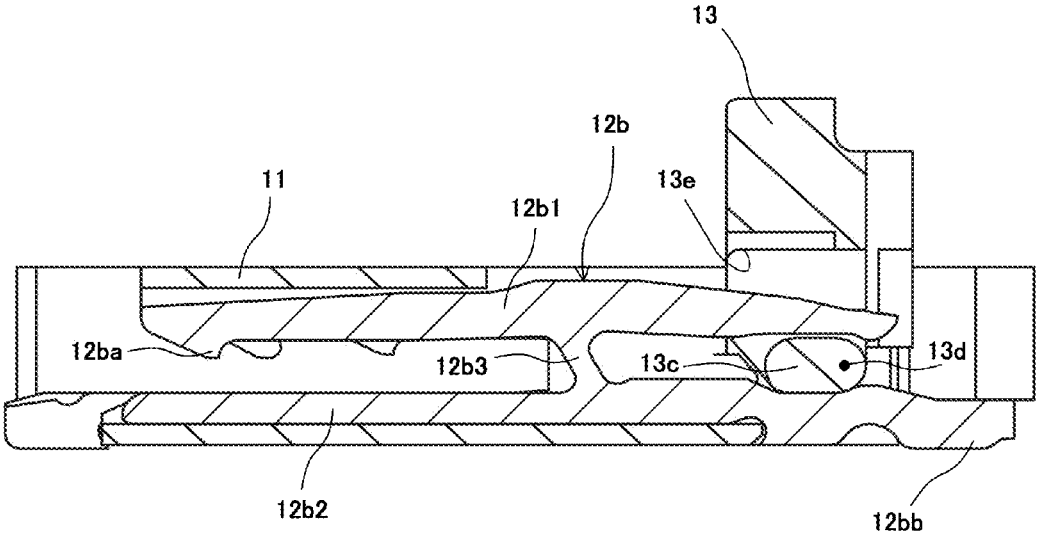
FIG. 4 is a cross-sectional view of the electrical connector along a line B-B in FIG. 2.
Figure 4:
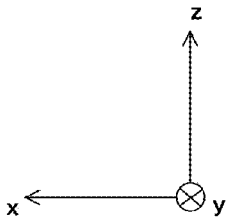

As illustrated in FIG. 4 (a cross-sectional view along a line B-B in FIG. 2), the shaft 13*c* is also held by the second contacts 12*b*.

The second contacts 12*b* each include a pair of beams 12*b*1, 12*b*2 (upper beam 12*b*1 and lower beam 12*b*2 that is longer than upper beam 12*b*1). In addition, the second contacts 12*b* each include a pillar 12*b*3 that connects the upper beam 12*b*1 with the lower beam 12*b*2. The second contacts 12*b* are each in a substantially H shape.

The pair of beams (upper beam 12*b*1 and lower beam 12*b*2) located at the one-end side of the second contact 12*b* with reference to the pillar 12*b*3 is disposed and exposed in the slot 15 of the housing 11. Between the pair of beams located at the one-end side of the second contact 12*b*, the upper beam 12*b*1 has an end portion provided with a second contact part 12*ba* that can abut the second electrode 51*b*.

Still further, the pair of beams (upper beam 12*b*1 and lower beam 12*b*2) located at the other-end side of the second contact 12*b* with reference to the pillar 12*b*3 (back side of the housing 11) are exposed at the back side of the housing 11. The shaft 13*c* of the actuator 13 is held between the pair of beams (upper beam 12*b*1 and lower beam 12*b*2). In addition, between the pair of beams located at the other-end side of the second contact 12*b*, the lower beam 12*b*2 has an end portion provided with a second connection part 12*bb* to be soldered to, for example, the electrode of the wiring board of an electronic device.

When the actuator 13 is in a free condition, the pair of beams (upper beam 12*b*1 and lower beam 12*b*2) at the other-end side of the second contact 12*b* (back side of the housing 11), and the pair of beams (upper beam 12*a*1 and lower beam 12*a*2) located at the other-end side of the first contact 12*a* are in a condition holding therebetween two points of the shaft 13*c* that form shorter sides thereof in the cross-sectional surface.

Hence, the gap between the pair of beams at the one-end side of the second contact 12*b* (slot-15 side), and the gap between the pair of beams at the one-end side of the first contact 12*a* become wider than those of the locked condition. Accordingly, the second contact part 12*ba* and the second electrode 51*b*, and, the first contact part 12*aa* and the first electrode 51*a* are in a non-contact condition or in a slightly contacting condition.

Still further, the shaft 13*c* can contact the lockings 14 illustrated in FIGS. 1 and 2. The lockings 14 each include, like the first and second contacts 12*a*, 12*b*, a pair of beams 14*a*, 14*b* (upper beam 14*a* and lower beam 14*b* that is longer than upper beam 14*a*). In addition, the lockings 14 each include a pillar (unillustrated) that connects the upper beam 14*a* with the lower beam 14*b*. The lockings 14 are each in a substantially H shape like the first and second contacts 12*a*, 12*b*.

The pair of beams located at the one-end side (slot-15 side) of the locking 14 with reference to the pillar is disposed and exposed in the slot 15 of the housing 11. Between the pair of beams located at the one-end side of the locking 14 with reference to the pillar, the upper beam 14*a* has an end portion provided with a pawl (unillustrated) that is a protrusion to be engaged with the cut-out 52 of the FPC 50.

Still further, the shaft 13*c* of the actuator 13 is disposed between the pair of beams (upper beam 14*a* and lower beam 14*b*) at the other-end side of the locking 14 with reference to the pillar (back side of the housing 11).

When, for example, as illustrated in FIGS. 3 and 4, the actuator 13 is in a free condition, the pair of beams (upper beam 14*a* and lower beam 14*b*) at the other-end side of the locking 14 (back side of the housing 11) is in a condition holding therebetween the two points of the shaft 13*c* that form the shorter sides thereof in the cross-sectional surface.

Hence, the gap between the pair of beams (upper beam 14*a* and lower beam 14*b*) at the one-end side of the locking 14 (slot-15 side) becomes wider than that of the locked condition. Accordingly, the user can fit the FPC 50 in the slot 15 of the housing 11, and tentatively retains the FPC 50 in the housing 11.

Figure 5:
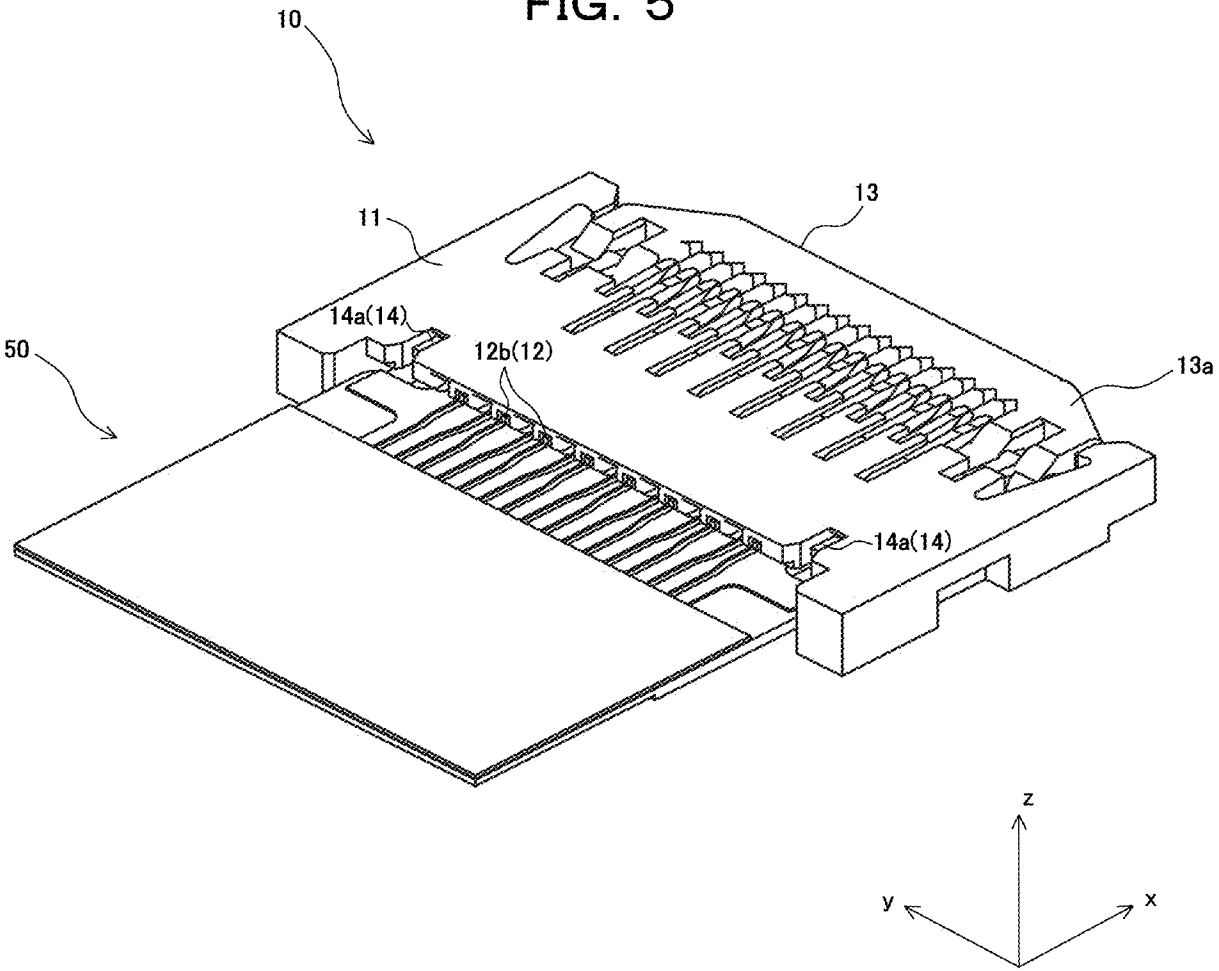
FIG. 5 is a perspective view when the actuator of the electrical connector of the present disclosure is in a locked condition.
Figure 6:
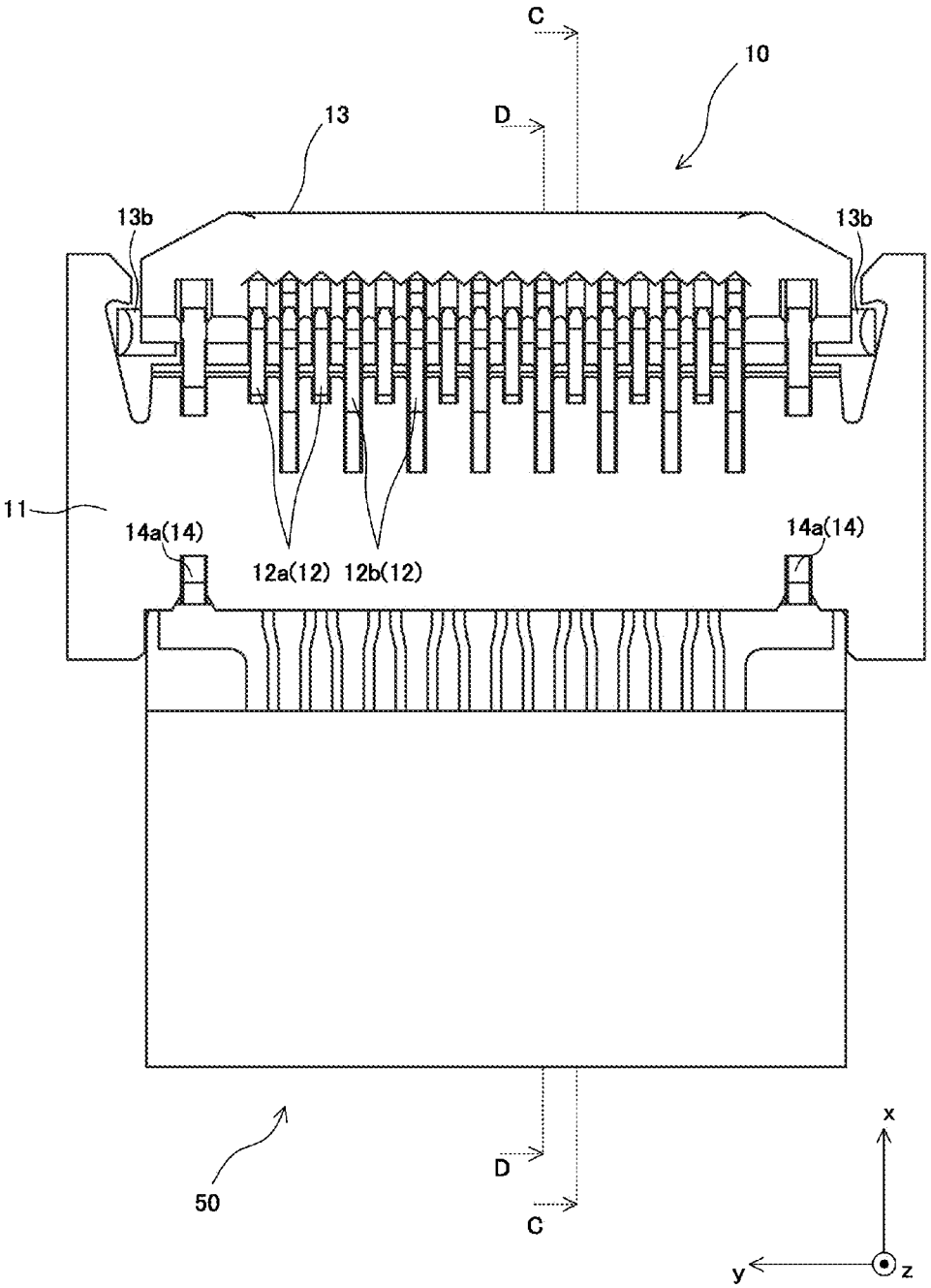
FIG. 6 is a top view when the actuator of the electrical connector of the present disclosure is in a locked condition.

When the operator rotates the actuator 13 that is in a free condition, as illustrated in FIGS. 5 and 6, the actuator 13 becomes a locked condition (substantially horizontal to the fitting direction of the FPC 50). While the actuator 13 is being rotated from the free condition to the locked condition, the shaft 13*c* of the actuator 13 rotates around the axial center 13*d*.

Figure 7:
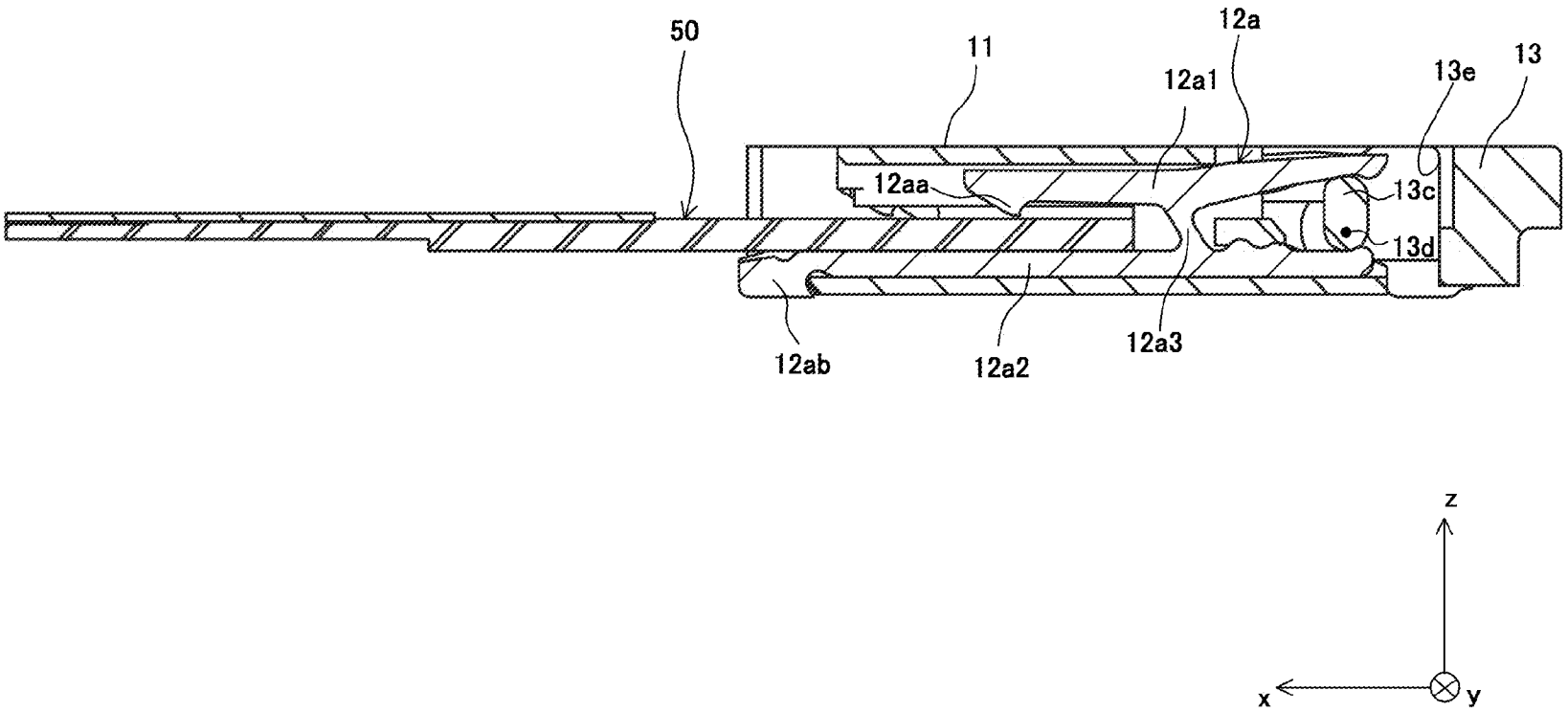
FIG. 7 is a cross-sectional view of the electrical connector along a line C-C in FIG. 6.

When the actuator 13 is in a locked condition, as illustrated in FIG. 7 (a cross-sectional view along a line C-C in FIG. 6), the pair of beams (upper beam 12*a*1 and lower beam 12*a*2) located at the other-end side of the first contact 12*a* is in a condition holding therebetween the two points of the shaft 13*c* that form the longer sides thereof in the cross-sectional surface.

Figure 8:
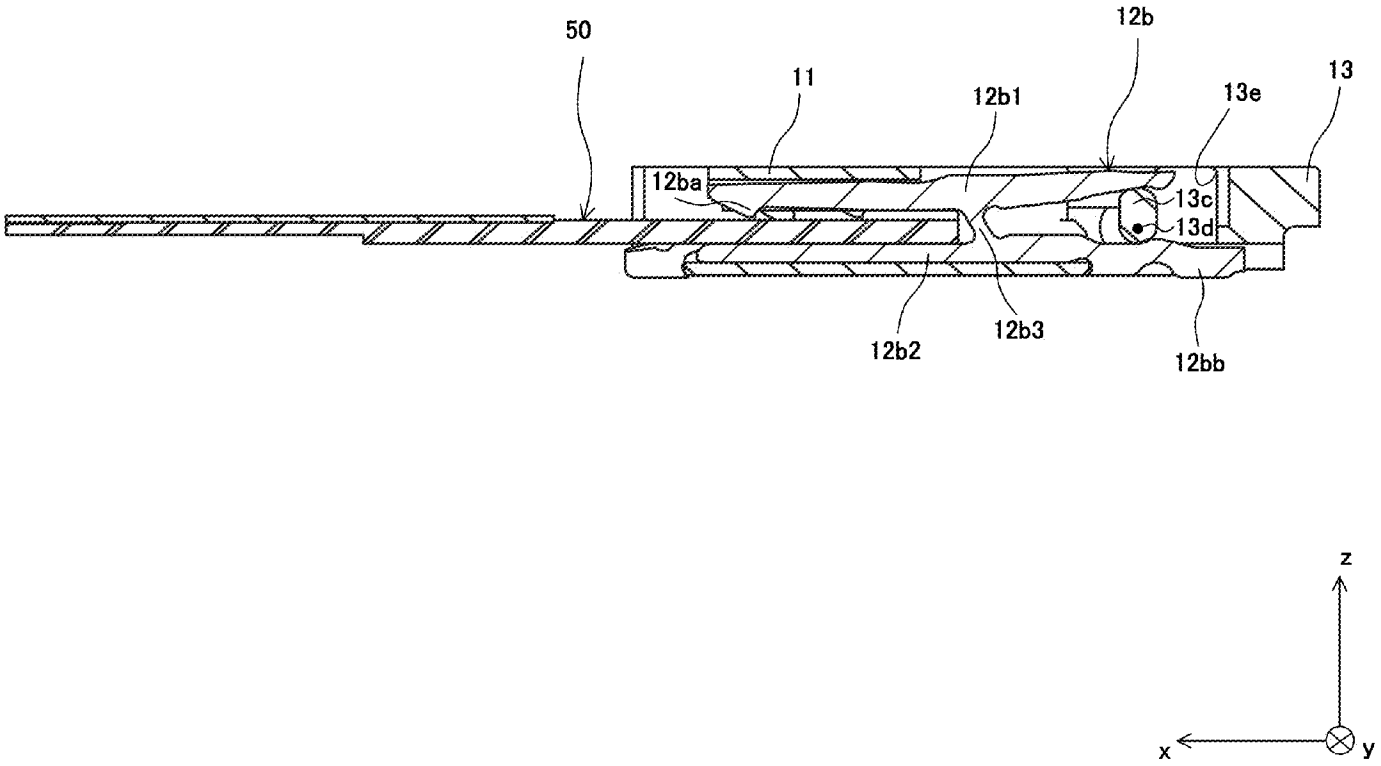
FIG. 8 is a cross-sectional view of the electrical connector along a line D-D in FIG. 6.

Likewise, when the actuator 13 is in a locked condition, as illustrated in FIG. 8 (a cross-sectional view along a line D-D in FIG. 6), the pair of beams (upper beam 12*b*1 and lower beam 12*b*2) located at the other-end side of the second contact 12*b* is in a condition holding therebetween the two points of the shaft 13*c* that form the longer sides thereof in the cross-sectional surface.

At this time, the gap between the pair of beams at the one-end side of the first contact 12*a* (slot-15 side), and the gap between the pair of beams at the one-end side of the second contact 12*b* are narrower than those of the free condition as illustrated in FIGS. 7 and 8. Hence, the first contact part 12*aa* and the first electrode 51*a*, and, the second contact part 12*ba* and the second electrode 51*b* become a contacting condition.

In addition, when the actuator 13 becomes a locked condition, the pair of beams (upper beam 14*a* and lower beam 14*b*) located at the other-end side of the locking 14 (back side of the housing 11) becomes a condition holding therebetween the two points of the shaft 13*c* that form the longer sides thereof in the cross-sectional surface.

At this time, the gap between the pair of beams at the one-end side of the locking 14 (slot-15 side) becomes narrower than that of the free condition. Hence, the pawl of the upper beam 14*a* located at the one-end side of the locking 14 catches the cut-out 52. Accordingly, the movement of the FPC 50 in the attaching/detaching direction that is −x direction is restricted, and thus the FPC 50 is eventually retained in the housing 11.

In this case, as illustrated in, for example, FIGS. 3, 4, 7 and 8, the upper beam 12*a*1 located at the other-end side of the first contact 12*a* (back side of the housing 11), and the upper beam 12*b*1 located at the other-end side of the second contact 12*b* are located at positions that allow the respective beams to abut the actuator 13.

Hence, the actuator 13 is formed with through-holes 13*e* in which the respective upper beams 12*a*1 located at the other-end side of the first contact 12*a* (back side of housing 11) and the respective upper beams 12*b*1 located at the other-end side of the second contact 12*b* are fitted so as to prevent those upper beams 12*a*1, 12*b*1 from abutting the actuator 13.

Figure 9A:
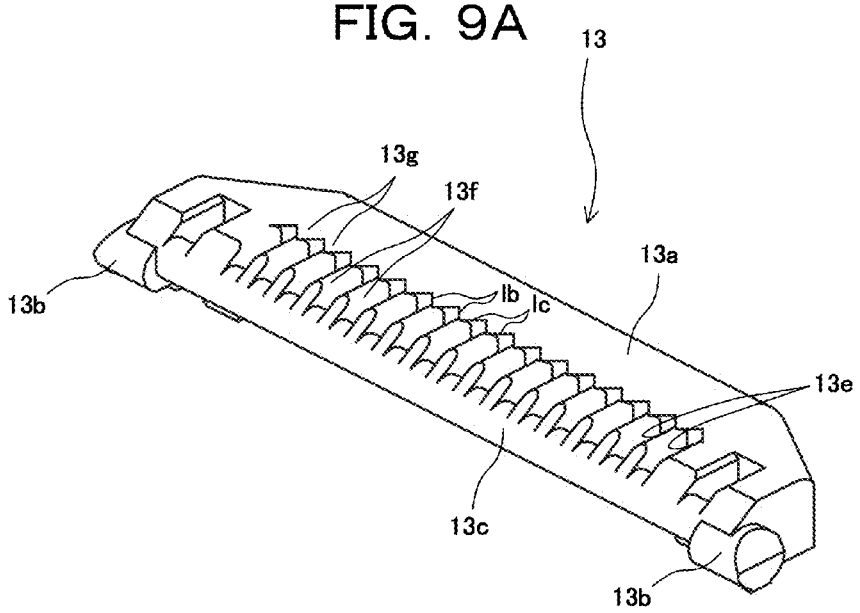
FIG. 9A is a perspective view of the actuator according to the first embodiment of the present disclosure.
Figure 9B:
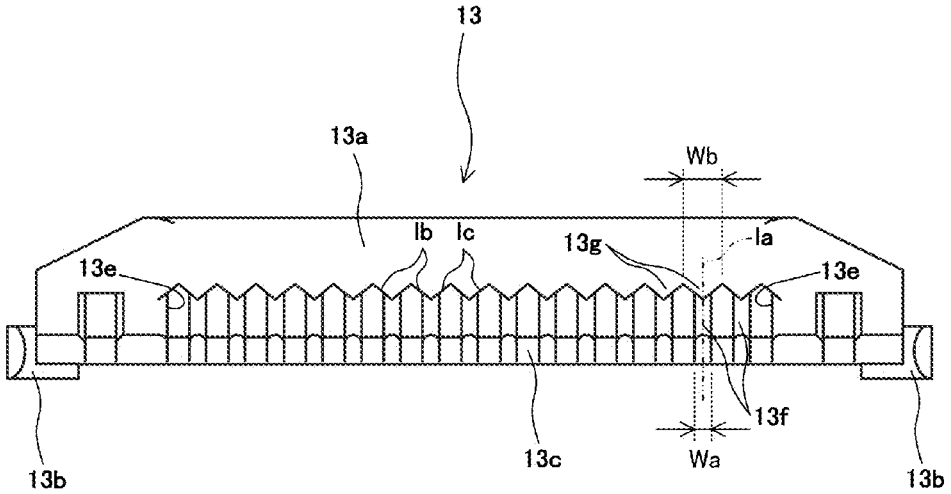
FIG. 9B is a top view of the actuator according to the first embodiment of the present disclosure.

As illustrated in FIGS. 9A and 9B, those through-hole 13*e* are partitioned by tabular partitions 13*f* each of which has one end connected to the operation part 13*a*, and also has the other end connected with the shaft 13*c* in order to suppress a reduction of the whole rigidity of the actuator 13 due to the formation of the through-holes 13*e*.

More specifically, the through-holes 13*e* are partitioned by the partitions 13*f* for each upper beam 12*a*1 located at the other-end side of the first contacts 12*a* and for each upper beam 12*b*1 located at the other-end side of the second contact 12*b* (for each beam disposed at a location that allows the beam to abut the actuator 13).

Disposed between the one end of the partition 13*f* and the operation part 13*a* is a wider-width part 13*g* that includes a wider-width surface with a wider width Wb than a width Wa of the one end of the partition 13*f*. In addition, among the contour lines of the wider-width surface of the wider-width part 13*g*, two lines 1*b*, 1*c* that couple the one end of the partition 13*f* with the operation part 13*a* are symmetrical straight lines with reference to a bisector 1*a* of the partition 13*f*. The width (gap) between the two straight lines 1*b*, 1*c* becomes wide toward the operation part 13*a* from the one end of the partition 13*f*, and thus the width of the wider-width surface increases.

As illustrated in FIG. 10A, the wider-width part 13*g* including the wider-width surface functions as follow when a resin containing a filler is filled in a die 80 that has the shape of the actuator 13 to integrally mold the actuator 13.

When the resin is flowed into an inlet 81 of the die 80, as illustrated in FIG. 10B, first, the resin flows in a portion where the operation part 13*a* is to be molded. Next, the resin that has flowed through the portion where the operation part 13*a* is to be molded flows in a portion where the respective wider-width parts 13*g* are to be molded as illustrated in FIG. 10C, and further flows in the portion where the respective partitions 13*f* are to be molded.

In this case, the portion of the die 80 where the respective wider-width parts 13*g* are to be molded is located at the upstream side in the flow of the resin relative to the portion where the respective partitions 13*f* are to be molded. In addition, the maximum width Wb of the portion of the die 80 where the wider-width surface of the wider-width part 13*g* is to be molded is greater than the length of the filler contained in the resin. Still further, among the contour lines of the wider-width surface of the portion where the wider-width part 13*g* is to be molded, the gap between the two straight lines 1*b*, 1*c* that couple the upstream side of the resin flow with the downstream side thereof becomes wide toward the upstream side from the downstream side, and the width of the wider-width surface increases.

Accordingly, the portion where the wider-width surface of the wider-width part 13*g* is to be molded can guide, to the portion where the partition 13*f* is to be molded, the filler contained in the resin flowing into the portion where the partition 13*f* is to be molded. The portion where the wider-width surface of the wider-width part 13*g* is to be molded can adjust the direction of the filler flowing into the portion where the partition 13*f* is to be molded.

Accordingly, the portion where the wider-width surface of the wider-width part 13*g* is to be molded prevents the filler from remaining at the coupling portion between the portion where the partition 13*f* is to be molded and the portion where the operation part 13*a* is to be molded, allowing the filler to easily flow into the portion where the partition 13*f* is to be molded.

Therefore, as illustrated in FIG. 10D, a sufficient filler can flow in the portion where the partition 13*f* is to be molded together with the resin. This enables the partition 13*f* to have sufficient rigidity.

Since the actuator 13 is integrally molded in this manner, as illustrated in FIGS. 9A and 9B, the actuator 13 is formed with the wider-width parts 13*g* at the respective one ends of the partitions 13*f* coupled with the operation part 13*a*. That is, the wider-width parts 13*g* are formed each of which has the maximum width greater than the length of the filler, and each of which has the width of wider-width surface increasing since the gap between the two straight lines 1*b*, 1*c* that couple the upstream side of the resin flow with the downstream side thereof among the contour lines of the wider-width surface increases toward the upstream side from the downstream side.

As explained above, according to the electrical connector 10 of the first embodiment, the wider-width parts 13*g* are disposed at the respective one ends of the partitions 13*f* corresponding to the upstream side of the resin flow to mold the respective partitions 13*f*. Hence, according to the electrical connector 10 of the first embodiment, the partitions 13*f* can have sufficient rigidity.

Second Embodiment

According to the above-explained electrical connector 10 of the first embodiment, the two lines 1*b*, 1*c* that couple the one end of the partition 13*f* with the operation part 13*a* to realize a width which becomes wide toward the upstream side of the resin flow from the downstream side thereof are both straight lines.

Figure 11A:
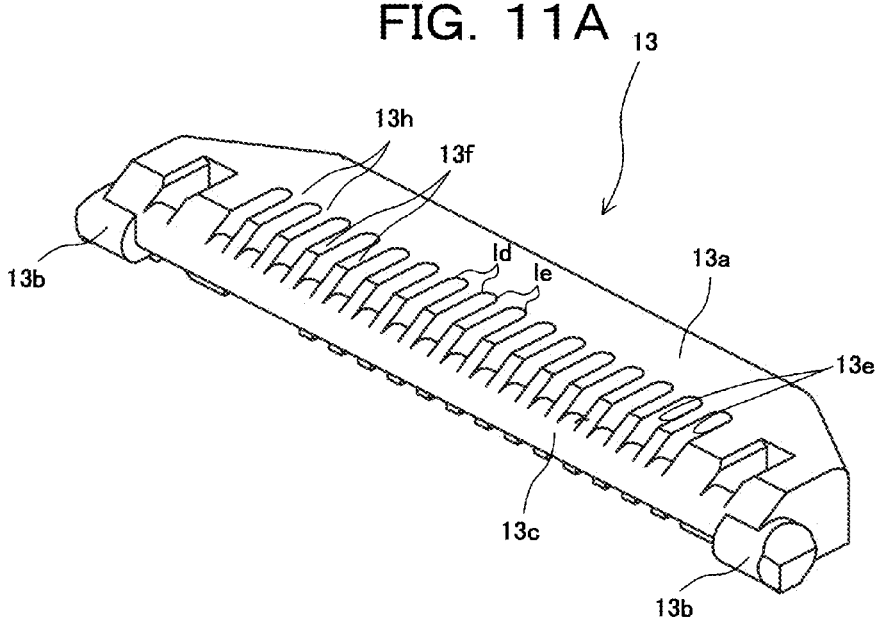
FIG. 11A is a perspective view of an actuator according to a second embodiment of the present disclosure.
Figure 11B:
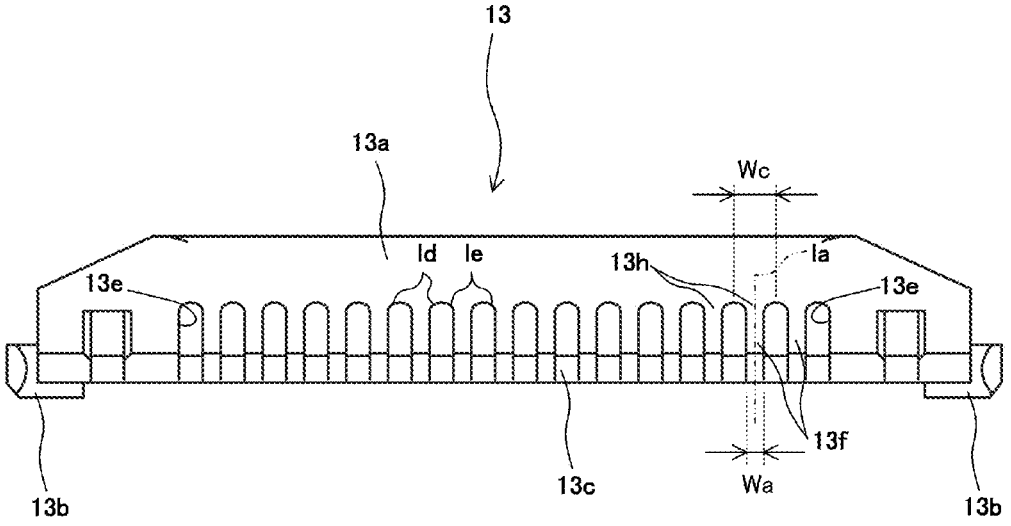
FIG. 11B is a top view of the actuator according to the second embodiment of the present disclosure.

Instead of this structure, according to the electrical connector 10 of the second embodiment, as illustrated in FIGS. 11A and 11B, two lines 1*d*, 1*e* that couple the one end of the partition 13*f* with the operation part 13*a* are both curved lines that increase a gap toward the upstream side of the resin flow from the downstream side thereof.

The other structures of the electrical connector 10 of the second embodiment are the same as those of the electrical connector 10 of the first embodiment.

Disposed between the one end of the partition 13*f* and the operation part 13*a* is a wider-width part 13*h* that has a wider-width surface with a width Wc which is larger than the width Wa of the one end of the partition 13*f*. The maximum width Wc of the wider-width part 13*h* is greater than the length of the filler contained in the resin.

In addition, among the contour lines of the wider-width surface of the wider-width part 13*h*, the two curved lines 1*d*, 1*e* that couple the one end of the partition 13*f* with the operation part 13*a* are symmetrical curved lines with reference to the bisector 1*a* of the partition 13*f*, and the gaps of the two curved lines become wide toward the operation part 13*a* from the one end of the partition 13*f*.

The resin filled in the inlet of the die first flows in a portion where the operation part 13*a* is to be molded, flows in a portion where the respective wider-width parts 13*h* are to be molded, and flows in a portion where the respective partitions 13*f* are to be molded. When the actuator 13 is integrally molded using a die that forms such a resin flow, the portion where the respective wider-width parts 13*h* are to be molded is located at the upstream side in the resin flow relative to the portion where the respective partitions 13*f* are to be molded.

In addition, in this die, the maximum width Wc of the portion where the wider-width surface of the wider-width part 13*h* is to be molded is greater than the length of the filler contained in the resin. Still further, among the contour lines of the wider-width surface of the portion where the wider-width part 13*h* is to be molded, the two lines 1*d*, 1*e* that couple the upstream side of the resin flow with the downstream side thereof have the respective gaps increasing toward the upstream side from the downstream side.

Accordingly, in the die for integrally molding the actuator 13, the portion where the wider-width surface of the wider-width part 13*h* is to be molded can guide, to the portion where the partition 13*f* is to be molded, the filler contained in the resin flowing into the portion where the partition 13*f* is to be molded. The portion where the wider-width surface of the wider-width part 13*h* is to be molded can adjust the direction of the filler flowing into the portion where the partition 13*f* is to be molded.

Accordingly, the portion where the wider-width surface of the wider-width part 13*h* is to be molded prevents the filler from remaining at the coupling portion between the portion where the partition 13*f* is to be molded and the portion where the operation part 13*a* is to be molded, allowing the filler to easily flow into the portion where the partition 13*f* is to be molded.

Therefore, a sufficient filler can flow in the portion where the partition 13*f* is to be molded together with the resin. This enables the partition 13*f* to have sufficient rigidity.

As explained above, according to the electrical connector 10 of the second embodiment, the wider-width parts 13*h* are provided each of which includes the two curved lines that couple the downstream side of the resin flow with the upstream side thereof. In the wider-width part 13*h*, the gap increases toward the upstream side of the resin flow from the downstream side thereof. Hence, a sufficient filler can be filled in the portion where the partition 13*f* is to be molded. Therefore, according to the electrical connector 10 of the second embodiment, the partition 13*f* can have sufficient rigidity.

Although the embodiments of the present disclosure were explained above, the present disclosure is not limited to the aforementioned embodiments, and various modifications and changes can be made thereto.

For example, according to the above-explained electrical connector 10 of the first embodiment, among the contour lines of the wider-width surface of the wider-width part 13*g*, the two straight lines 1*b*, 1*c* that couple the upstream side of the resin flow with the downstream side thereof (that couple the operation part 13*a* with the one end of the partition 13*f*) are symmetrical straight lines with reference to the bisector 1*a* of the partition 13*f*.

However, the present disclosure is not limited to this structure. The two straight lines 1*b*, 1*c* that couple the operation part 13*a* with the one end of the partition 13*f* may increase the width of the wider-width surface of the wider-width part 13*g* toward the operation part 13*a* from the one end of the partition 13*f*.

Hence, in the electrical connector 10, for example, either one of the two straight lines 1*b*, 1*c* that couple the one end of the partition 13*f* with the operation part 13*a* may not be in parallel with the bisector 1*a* of the partition 13*f* like the electrical connector 10 of the first embodiment, and the other straight line may be in parallel with the bisector 1*a* of the partition 13*f*.

Likewise, according to the above-explained electrical connector 10 of the second embodiment, among the contour lines of the wider-width surface of the wider-width part 13*h*, the two curved lines 1*d*, 1*e* that couple the upstream side of the resin flow with the downstream side thereof (that couple the operation part 13*a* with the one end of the partition 13*f*) are symmetrical curved lines with reference to the bisector 1*a* of the partition 13*f*.

However, the present disclosure is not limited to this structure. The two curved lines that couple the operation part 13*a* with the one end of the partition 13*f* may increase the width of the wider-width surface of the wider-width part 13*h* toward the operation part 13*a* from the one end of the partition 13*f*.

Hence, in the electrical connector 10, for example, either one of the two lines that couple the one end of the partition 13*f* with the operation part 13*a* may be a curved line like the electrical connector 10 of the second embodiment, and the other line may be a straight line in parallel with the bisector 1*a* of the partition 13*f*.

In addition, according to the above-explained electrical connectors 10 of the first and second embodiments, first, the resin filled in the inlet of the die is caused to flow in the portion where the operation part 13*a* is to be molded to integrally mold the actuator 13. In order to do so, the wider-width part 13*h*, 13*g* is disposed between the one end of the partition 13*f* and the operation part 13*a*.

However, the present disclosure is not limited to this case. The portion where the wider-width part 13*h*, 13*g* is to be molded in the die is provided so as to guide the filler contained in the resin flowing into the portion where the partition 13*f* is to be molded.

Accordingly, when, for example, the inlet of the die is continuous with the portion where the shaft 13*c* is to be molded, the resin filled in the inlet first flows in the portion where the shaft 13*c* is to be molded, and eventually flows in the portion where the operation part 13*a* is to be molded. When the actuator 13 is integrally molded in this manner, the portion where the wider-width part 13*g*, 13*h* is to be molded is disposed between the portion where the shaft 13*c* is to be molded corresponding to the upstream side of the resin flow, and the portion where the partition 13*f* is to be molded.

Accordingly, the wider-width part 13*g*, 13*h* is disposed between the shaft 13*c* and the one end of the partition 13*f* coupled with the shaft 13*c*. The wider-width part 13*g*, 13*h* each includes a wider-width surface that increases the width toward the upstream side of the resin flow from the downstream side thereof (toward the shaft 13*c* from the one end of the partition 13*f*). The widths of the wider-width surfaces are Wb and Wc which are larger than the width Wa of the one end of the partition 13*f*.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

REFERENCE SYMBOLS

10 Electrical connector, 11 Housing, 12 Contact, 12*a* First contact, 12*b* Second contact, 12*a*1, 12*b*1, 14*a* Upper beam, 12*a*2, 12*b*2, 14*b* Lower beam, 12*a*3, 12*b*3 Pillar, 12*aa* First contact part, 12*ab* First connection part, 12*ba* Second contact part, 12*bb* Second connection part, 13 Actuator, 13*a* Operation part, 13*b* Abutting part, 13*c* Shaft, 13*d* Axial center, 13*e* Through-hole, 13*f* Partition, 13*g*, 13*h* Wider-width part, 14 Locking, 15 Slot, 50 FPC, 51 Electrode, 51*a* First electrode, 51*b* Second electrode, 52 Cut-out, 80 Die, 81 Inlet, 1*a* Bisector, 1*b*, 1*c* Straight line, 1*d*, 1*e* Curved line

What is claimed is:

1. An electrical connector comprising:

an insulative housing that is formed with a slot in which a tabular signal transmission member is fittable;

a plurality of contacts each comprising an elastic conductor in a substantially H shape including a pair of beams and a pillar that connects the pair of beams with each other, the pair of beams located at one-end side with reference to the pillar being disposed in the slot of the housing so as to correspond to respective electrodes of the signal transmission member fitted in the housing through the slot; and an actuator attached to the housing in a freely rotatable manner, including a shaft which is held between the pair of beams at an other-end side with reference to the pillar, and which is rotatable around an axial center along with the rotation of the actuator, and enabling the plurality of contacts to contact the electrodes upon rotation of the shaft, wherein the actuator comprises:

an operation part to be rotated;

a tabular partition that is, at one end of the tabular partition, connected to the operation part and, at the other end of the partition, connected to the shaft and that partitions, for each beam located at a position that allows the beam to abut the actuator, a through-hole into which one of the pair of beams located at the other-end side and at the position that allows the beam to abut the actuator is inserted to prevent the beam from abutting the actuator; and a wider-width part including a wider-width surface which connects, to the operation part and the shaft, the one end or the other end of the partition corresponding to an upstream side of a flow of resin flowed to mold the partition when the actuator is molded by the resin containing a filler, which has a wider width than a width of the partition, which corresponds to a flow path for the flow of resin to the one end or the other end of the partition from the operation part or the shaft during molding, which forms an increase, from a downstream side of the flow of resin toward the upstream side, in the width of the flow path of the flow of resin, and which has a maximum width of which is greater than a length of the filler, the wider-wide part guiding, to the portion where the partition is to be molded, the filler contained in the resin and the wider-wide part adjusting the direction of the filler flowing into the portion where the partition is to be molded.

2. The electrical connector according to claim 1, wherein: the wider-width part is disposed between the operation part corresponding to the upstream side of the resin flow and the one end of the partition.

3. The electrical connector according to claim 1, wherein: the wider-width part is disposed between the shaft corresponding to the upstream side of the resin flow and the one end of the partition.

4. The electrical connector according to claim 1, wherein, among contour lines of the wider-width surface, two lines that couple the upstream side of the resin flow with the downstream side thereof are straight lines that increase the width of the wider-width surface toward the upstream side from the downstream side.

5. The electrical connector according to claim 1, wherein, among contour lines of the wider-width surface, two lines that couple the upstream side of the resin flow with the downstream side thereof are curved lines that increase the width of the wider-width surface toward the upstream side from the downstream side.

* * * * *